US008833927B2

(12) United States Patent
Leighton et al.

(10) Patent No.: US 8,833,927 B2
(45) Date of Patent: Sep. 16, 2014

(54) PRINTER HAVING SKEWED TRANSFIX ROLLER TO REDUCE TORQUE DISTURBANCES

(75) Inventors: Roger G. Leighton, Hilton, NY (US); Michael F. Leo, Penfield, NY (US); Bin Zhang, Penfield, NY (US); Joannes N. M. deJong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 100 days.

(21) Appl. No.: 13/495,483

(22) Filed: Jun. 13, 2012

(65) Prior Publication Data

US 2013/0335496 A1 Dec. 19, 2013

(51) Int. Cl.
*B41J 2/01* (2006.01)

(52) U.S. Cl.
USPC ..... 347/103; 347/104; 347/101; 347/102

(58) Field of Classification Search
USPC ..... 347/103, 101, 104, 102; 101/328, 375
See application file for complete search history.

(56) References Cited

U.S. PATENT DOCUMENTS

| | | | | |
|---|---|---|---|---|
| 4,448,872 | A | 5/1984 | Vandervalk | |
| 4,726,293 | A * | 2/1988 | Ende | 101/228 |
| 5,795,087 | A | 8/1998 | Brower et al. | |
| 5,956,069 | A | 9/1999 | Blanding | |
| 6,347,210 | B1 | 2/2002 | Fotland | |
| 6,697,601 | B1 | 2/2004 | Kamimura et al. | |
| 7,195,238 | B2 | 3/2007 | Suga et al. | |
| 7,319,842 | B2 | 1/2008 | Koyanagi et al. | |
| 7,607,660 | B2 | 10/2009 | Inoue | |
| 7,798,491 | B2 | 9/2010 | Moteki et al. | |
| 2004/0252175 | A1 * | 12/2004 | Bejat et al. | 347/103 |
| 2010/0236438 | A1 | 9/2010 | Roof et al. | |
| 2011/0279503 | A1 | 11/2011 | Mizes et al. | |

* cited by examiner

*Primary Examiner* — Henok Legesse
(74) *Attorney, Agent, or Firm* — Maginot, Moore & Beck, LLP

(57) ABSTRACT

An inkjet offset printer includes an imaging drum and a transfix roller skewed with respect to and defining a continuously applied or an uninterrupted nip with the imaging drum to reduce torque disturbances and media wrinkling issues. Acoustic and physical disturbances resulting from a sheet of recording media entering and leaving the nip are reduced or eliminated.

20 Claims, 4 Drawing Sheets

PRINTER HAVING SKEWED TRANSFIX ROLLER TO REDUCE TORQUE DISTURBANCES

TECHNICAL FIELD

This disclosure relates generally to solid ink offset printers, and more particularly to a transfix roller skewed with respect to an imaging drum and defining a continuously applied or uninterrupted nip with an imaging drum to reduce torque disturbances.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the image receiving surface. In these solid ink printers, also known as phase change inkjet printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to a gelatinous state, in the case of gel ink.

A typical inkjet printer uses one or more printheads with each printhead containing an array of individual nozzles through which drops of ink are ejected by inkjets across an open gap to an image receiving member having an image receiving surface to form an ink image during printing. The image receiving surface can be the surface of a continuous web of recording media, a series of media sheets, or the surface of an image receiving member, which can be an imaging drum, a rotating print drum, or an endless belt. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that are operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

Phase change inkjet printers form images using either a direct or an offset print process. In a direct print process, melted ink is jetted directly onto recording media to form images. In an offset print process, also referred to as an indirect print process, melted ink is jetted onto a surface of a rotating member such as the surface of a rotating drum, belt, or band.

Indirect inkjet printers are capable of producing either simplex or duplex prints. Simplex printing refers to production of an image on only one side of a print media. Duplex printing produces an image on each side of a media sheet. In duplex indirect printing, an ink image is initially formed on a rotating drum and then transferred to the media. The media sheet is then inverted and sent along a path that passes the second side of the media sheet by the rotating drum upon which the ink has been deposited for the formation of a second ink image on the second side.

Recording media are heated and are moved proximate the surface of the rotating member in synchronization with the ink images formed on the surface. The recording media are then pressed against the surface of the rotating member as the media passes through a nip formed between the rotating member and a transfix roller. The ink images are transferred and affixed to the recording media by the pressure in the nip. This process of transferring an image to the media is known as a "transfix" process.

The nip is maintained at a high pressure by forcing a high durometer synthetic transfix roller against the rotating member. As the rotating member rotates, the recording media is pulled into and through the nip and is pressed against the deposited ink image by the opposing surfaces of the transfix roller and the rotating member. The high pressure conditions within the nip compress the media and ink together, spread the ink droplets, and fuse the ink droplets to the media. Heat from the preheated media heats the ink in the nip, making the ink sufficiently soft and tacky to adhere to the print media. When the print media leaves the nip, stripper fingers or other like members peel it from the printer member and direct it into a media exit path.

Increased printing speeds can be achieved by increasing the rotational speed of the imaging drum or by increasing the diameter of the imaging drum. If the diameters are increased, the width of the nip increases. In addition, as print speed increases, higher pressures are required at the nip, which also increases the width of the nip. Consequently as print speeds increase, the shape and size of the nip can affect print conditions.

Because the application of the high pressures needed for high speed imaging results in deformation of the transfix roller, the shape of the transfix roller can affect the shape and size of the nip as well. In some printers, a transfix roller having a "crowned profile" can be used to provide a desired nip and nip width. A "crowned profile" is a profile wherein the diameter of the transfix roller located at the middle of the roller is larger than the diameter of the transfix roller located at the ends of the roller. Transfix rollers with a crowned profile can provide a desired image quality, roller life, and acceptable cost. In other printers, a transfix roller having a flat profile can be used.

A nip typically includes a length defined by the length of the transfix roller and the force of contact between the transfix roller and the image receiving member. For instance in a transfix roller having a crown, the length of the nip can be shorter than the length of the roller. The width of the nip, which is measured in the process direction is defined by the pressure applied between the transfix roller and the image receiving member and the materials comprising the transfix roller and the image receiving member.

The transferred ink drops should spread out to cover a specific area to preserve image resolution. Too little spreading leaves gaps between the ink drops while too much spreading results in intermingling of the ink drops. Additionally, the nip conditions should be controlled to maximize the transfer of ink drops from the image receiving member to the print media without compromising the spread of the ink drops on the print media. Moreover, the ink drops should be pressed into the paper with sufficient pressure to fix the ink drops to the paper. Otherwise, the ink drops can be inadvertently removed by abrasion resulting in poor image quality. Therefore, to optimize image resolution, the conditions within the nip should be carefully controlled.

SUMMARY

An indirect printer prints solid wax images on media sheets at approximately 250 pages per minute using a transfix process with a skewed transfix roller. The skewed transfix roller reduces torque disturbances, including motion artifacts generated at the leading edge and the trailing edge of the media sheet. The printer is configured to form ink images on a plurality of sheets of recording media moving in a process direction and includes an image receiving member defining a first longitudinal axis substantially aligned in a cross-process direction and which is configured to receive the ink images. A transfix roller is disposed adjacently to the image receiving member and defines a second longitudinal axis skewed with respect to the first longitudinal axis to define a nip. The transfix roller is configured to continuously engage the image receiving member from a trailing edge of a first sheet of the plurality of sheets of recording media to a leading edge of a second sheet of the plurality of sheets of recording media.

A method of offset printing an image on a cut sheet of recording media moving along a process direction in an inkjet printer includes a transfix roller disposed adjacently to an image receiving member. The method includes engaging the transfix roller with the image receiving member to form a nip with the image receiving member wherein the transfix roller is skewed with respect to the process direction, forming a first image on the image receiving member, forming a space on the image receiving member after forming the first image, forming a second image on the image receiving member after forming the space, and maintaining engagement of the transfix roller with the image receiving member during forming the first image, forming the space, and forming the second image.

BRIEF DESCRIPTION OF THE DRAWINGS

The foregoing aspects and other features of a printer including an image receiving member and a transfix roller are explained in the following description, taken in connection with the accompanying drawings.

DETAILED DESCRIPTION

Figure 1:
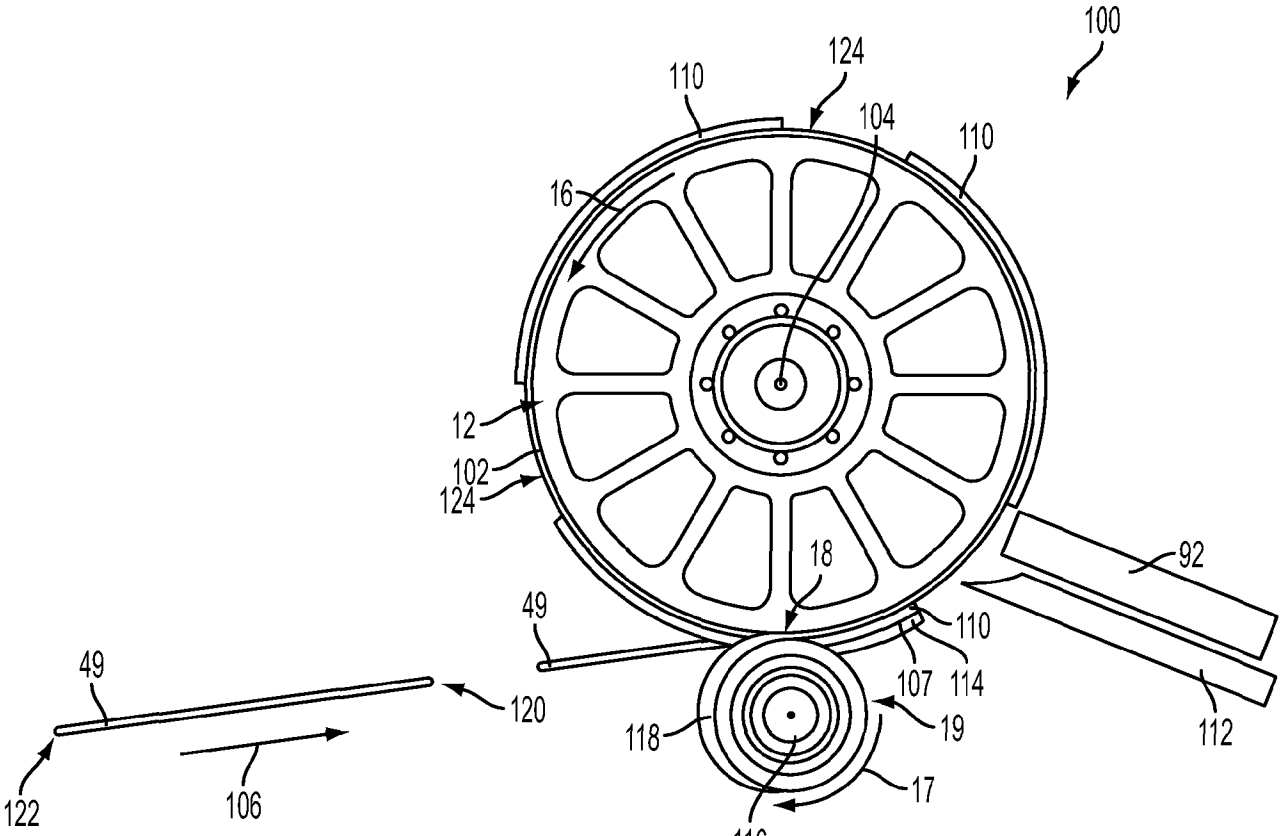
FIG. 1 is a schematic side elevational view of an image receiving member and a transfix roller having a longitudinal axis being offset from a longitudinal axis of the image receiving member.

For a general understanding of the environment for the system and method disclosed herein as well as the details for the system and method, reference is made to the drawings. In the drawings, like reference numerals have been used throughout to designate like elements. As used herein the term "printer" refers to any device that produces ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various recording media including paper.

Figure 5:
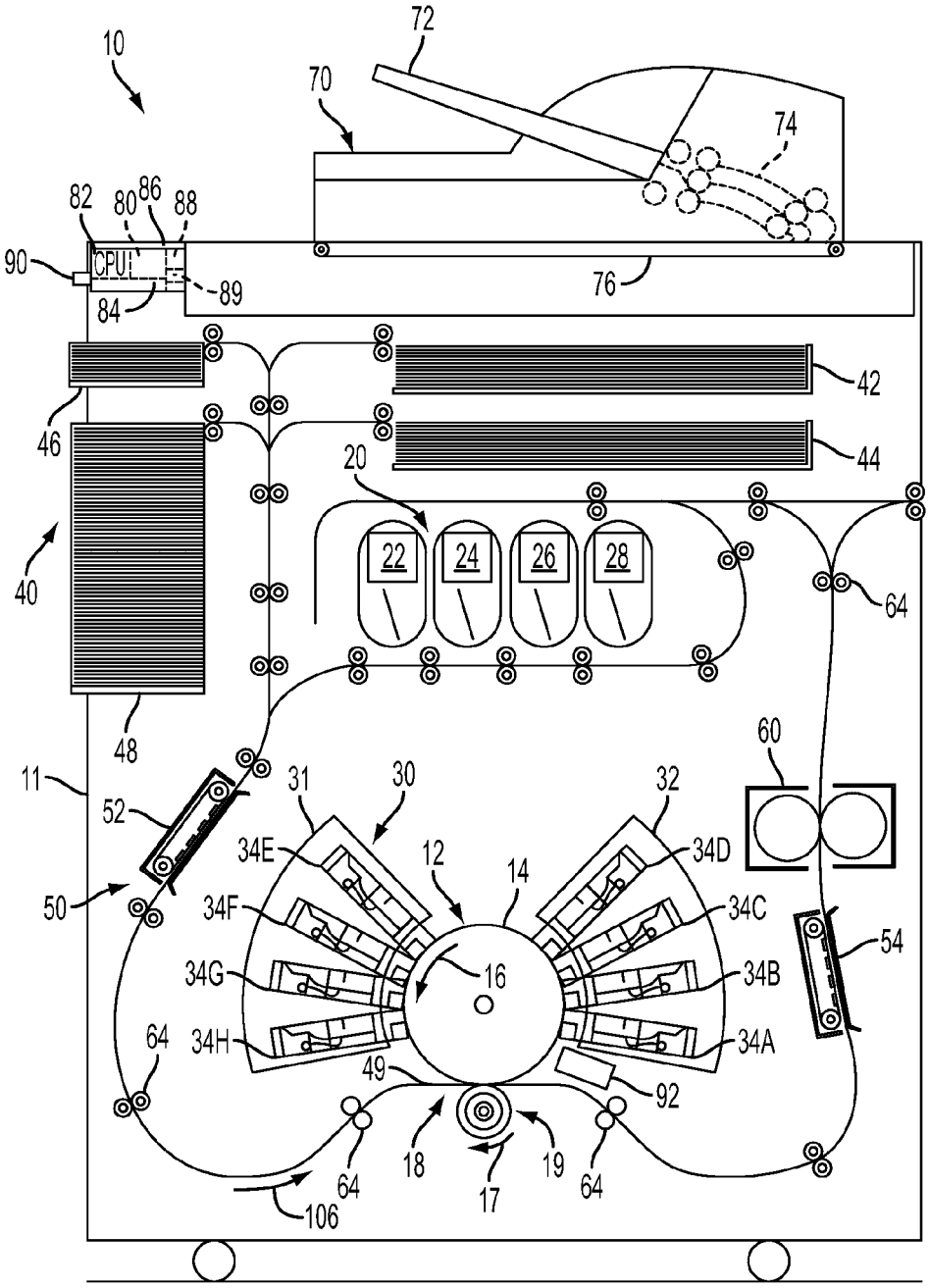
FIG. 5 is a schematic side view of an inkjet printer configured to print images onto a rotating image receiving member and to transfer the images to recording media.

FIG. 5 illustrates a high-speed phase change ink image producing machine or printer 10. As illustrated, the printer 10 includes a frame 11 supporting directly or indirectly operating subsystems and components, as described below. The printer 10 includes an image receiving member 12 that is shown in the form of a drum, but can also include a supported endless belt. The image receiving member 12 has an imaging surface 14 that is movable in a direction 16, and on which phase change ink images are formed. A transfix roller 19 rotatable in the direction 17 is loaded against the surface 14 of drum 12 to form a transfix nip 18, within which ink images formed on the surface 14 are transfixed onto a recording media 49.

The high-speed phase change ink printer 10 also includes a phase change ink delivery subsystem 20 that has at least one source 22 of one color phase change ink in solid form. Since the phase change ink printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30.

In this embodiment, the printhead system 30 includes a first printhead support 31 and a second printhead support 32 each of which provides support for a plurality of printhead modules, also known as print box units 34A through 34H. Each printhead module 34A-34H effectively extends across the width of the media and deposits ink onto the surface 14 of the image receiving member 12. A printhead module can include a single printhead or a plurality of printheads in a staggered arrangement that are operatively connected to a frame (not shown) and aligned to deposit the ink to form an ink image on the surface 14. The printhead modules 34A-34H can include associated electronics, ink reservoirs, and ink conduits to supply ink to the one or more printheads. In this embodiment however conduits (not shown) operatively connect the sources 22, 24, 26, and 28 to the printhead modules 34A-34H to provide a supply of ink to the one or more printheads in the module. As is generally familiar, the one or more printheads of a printhead module eject a single color of ink. Typically, the printheads of one printhead module are offset by a distance that is one-half the distance between nozzles in a printhead from the printheads of another printhead module that ejects the same color of ink. This arrangement enables the two printhead modules to print at a higher resolution than the resolution provided by a single printhead module. By arranging a pair of printhead modules in this manner for each color of ink used in a CMYK printer, each color can be printed at the higher resolution. For instance, printhead modules 34A and 34B can deposit cyan ink, modules 34C and 34D can deposit magenta ink, modules 34E and 34F can deposit yellow ink, and modules 34G and 34H can deposit block. By offsetting or staggering the two printhead modules printing with the same color of ink the resolution of a color separation can be increased from, for example, 300 dpi, the resolution printed by a single printhead module, to 600 dpi, the resolution printed by the pair of modules ejecting the same color. Although eight of the printhead modules 34 are illustrated, other numbers of printhead modules 34 can be provided.

As further shown, the phase change ink printer 10 includes a recording media supply and handling system 40, also known as a media transport. The recording media supply and handling system 40, for example, can include sheet or substrate supply sources 42, 44, 46, and 48, of which supply source 48, for example, is a high capacity paper supply or feeder for storing and supplying image receiving substrates in the form of cut media sheets 49, for example. The recording media supply and handling system 40 also includes a substrate handling and transport system 50 that has a substrate heater or pre-heater assembly 52 and a substrate and image heater 54. A fusing device 60 can optionally be provided to apply post-processing techniques to the images and the substrate. The phase change ink printer 10 can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34H (and thus the printheads), the substrate supply and handling system 40, and the substrate handling and transport system 50. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34H. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the processes, described more fully below, that enable the printer to perform drum maintenance unit (DMU) maintenance procedures and DMU cycles selectively. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and output to the printhead modules 34A-34H. Additionally, the controller 80 determines and/or accepts related subsystem and component controls, for example, from operator inputs via the user interface 86, and accordingly executes such controls. As a result, appropriate color solid forms of phase change ink are melted and delivered to the printhead modules 34A-34H. Additionally, pixel placement control is exercised relative to the imaging surface 14 thus forming desired images per such image data, and receiving substrates, which can be in the form of media sheets 49, are supplied by any one of the sources 42, 44, 46, 48 and handled by recording media transport system 50 in timed registration with image formation on the surface 14. Finally, the image is transferred from the surface 14 and fixedly fused to the image substrate within the transfix nip 18.

In some printing operations, a single ink image can cover the entire surface of the image receiving member 12 (single pitch) or a plurality of ink images can be deposited on the image receiving member 12 (multi-pitch). Furthermore, the ink images can be deposited in a single pass (single pass method), or the images can be deposited in a plurality of passes (multi-pass method). When images are deposited on the image receiving member 12 according to the multi-pass method, under control of the controller 80, a portion of the image is deposited by the printheads within the printhead modules 34 during rotation of the image receiving member 12.

In one type of printing architecture, images can be prepared by accumulating multiple color separations. During rotation of the image receiving member 12, ink droplets for one of the color separations are ejected from the printheads and deposited on the surface 14 of the image receiving member 12 until the last color separation is deposited to complete the image. In some cases, for example cases in which secondary or tertiary colors are used; one ink droplet or pixel can be placed on top of another one, as in a stack. Another type printing architecture generates images from multiple swaths of ink droplets ejected from the print heads. During rotation of the image receiving member 12, ink droplets for one of the swaths (each containing a combination of all of the colors) are applied to the surface of the image receiving member 12 until the last swath is applied to complete the ink image. Both of these examples of multi-pass architectures perform what is commonly known as "page printing." Each image comprised of the various component images represents a full sheet of information worth of ink droplets which, as described below, is then transferred from the image receiving member 12 to a recording media.

In a multi-pitch printing architecture, the surface of the image receiving member can be partitioned into multiple segments, each segment including a full page image (i.e., a single pitch) and an interpanel zone or space. For example, a two pitch image receiving member is capable of containing two images separated by the interpanel zone, each corresponding to a single sheet of recording media, during a revolution of the image receiving member 12. Likewise, for example, a four pitch image receiving member is capable of containing four images, each corresponding to a single sheet of recording media, during a pass or revolution of the image receiving member.

Once an image or images have been printed on the image receiving member 12 under control of the controller 80 in accordance with an imaging method, such as the single pass method or a multi-pass method, the exemplary inkjet printer 10 begins a process for transferring and fixing the image or images at the transfix roller 19 from the image receiving member 12 onto the recording media 49. According to this process, a sheet of recording media 49 is transported by transport system 50 under control of the controller 80 to a position adjacent the transfix roller 19 and then through the nip 18 formed at the interface between the transfix roller 19 and image receiving member 12. The transfix roller 19 applies pressure against the back side of the recording media 49 in order to press the front side of the recording media 49 against the image receiving member 12. Although the transfix roller 19 can also be heated, in this exemplary embodiment, it is not. Instead, the pre-heater assembly 52 for the recording media 49 is provided in the media path leading to the nip. The pre-heater assembly 52 provides the necessary heat to the recording media 49 for subsequent aid in transfixing the image to the media, thus simplifying the design of the transfix roller. The pressure produced by the transfix roller 19 on the back side of the heated recording media 49 facilitates the transfixing (transfer and fusing) of the image from the image receiving member 12 onto the recording media 49.

The rotation or rolling of both the image receiving member 12 and transfix roller 19 not only transfixes the images onto the recording media 49, but also assists in transporting the recording media 49 through the nip. The image receiving member 12 continues to rotate to continue the transfix process for the images previously applied to the surface 14 of the image receiving member 12. Any residual ink left on the image receiving member 12 can removed under control of the controller 80 by drum maintenance procedures performed at a drum maintenance unit 92.

The DMU 92 can include a release agent applicator, a metering blade, and, in some embodiments, a cleaning blade. The release agent applicator can further include a reservoir having a fixed volume of release agent such as, for example, silicone oil, and a resilient donor roller, which can be smooth or porous and is rotatably mounted in the reservoir for contact with the release agent and the metering blade. The metering blade is compliant such that it can firmly and uniformly contact the image receiving member. The cleaning blade is also compliant such that it can firmly and uniformly contact the image transfer surface 14. The DMU 92 is operably connected to the controller 80 such that the donor roller, metering blade and cleaning blade are selectively moved by the controller 80 into temporary contact with the rotating image receiving member 12 to deposit and distribute release agent onto and remove un-transferred ink pixels from the surface of the member 12.

The primary function of the release agent is to prevent the ink from adhering to the image receiving member 12 during transfixing when the ink is being transferred to the recording media 49. The release agent also aids in the protection of the transfix roller 19. Small amounts of the release agent are transferred to the transfix roller 19 and this small amount of release agent helps prevent ink from adhering to the transfix roller 19. Consequently, a minimal amount of release agent on the transfix roller 19 is acceptable.

To manage the application and distribution of the release agent on the image receiving member and the recording media, the controller 80 can periodically operate the DMU 92 to perform a DMU cycle. A DMU cycle is comprised of multiple functions including applying a uniform layer of release agent, cleaning un-transferred pixels from the previous image off of the image transfer surface, and eliminating differential glosses in the amount of release agent remaining on the image receiving member following the printing of an image.

The image receiving member 12 has a tightly controlled surface that provides a microscopic reservoir capacity to hold the release agent. Too little release agent present in areas or over the entire image receiving member prevents transfer of the ink pixels to the recording media 49. This image defect is referred to herein as "image dropout" when it occurs over particular areas or pixels of the ink image and "cohesive image transfer failure" when it occurs over the entirety of the ink image. Conversely, too much release agent present on the image receiving member 12 results in transfer of some release agent to the back side of the recording media 49. If the recording media 49 is then printed on both sides in duplex printing, the ink pixels may not adhere properly to the second side of the recording media 49. To combat these image defects, each DMU cycle selectively applies and meters release agent onto the surface of the image receiving member 12 by bringing the donor roller and then the metering blade of the release agent applicator 94 into contact with the surface of the image receiving member 12 prior to subsequent printing of images on the image receiving member 12 by the printheads in modules 34. These actions replenish the release agent to the reservoir on the surface of the image receiving member 12 to prevent image failure and ensure continued application of a uniform layer of release agent to the surface of the image receiving member 12.

To clean un-transferred pixels or image dropouts from the previous image off the image receiving member surface 14, the controller 80 brings the metering and/or cleaning blade into contact with the image receiving member 12 following the printing of an image. If these dropout pixels are not removed by the DMU 92 they are typically transfixed onto the next image that is printed. These pixels can produce image defects, especially when the stray pixel is transfixed onto a field of high coverage yellow or white space. This defect, or "freckling", is an image dropout that was not collected by the DMU 92.

Referring now to FIG. 1, the printer system 10 is modified to include a multi-pitch image receiving system 100 capable of imaging a plurality of images, each corresponding to a single sheet of recording media printed during a single pass or revolution of the image receiving member 12. While the multi-pitch image receiving system 100 of FIG. 1 is illustrated as including three images, other numbers of images are possible. For instance, in one embodiment the image receiving member 12 can include a diameter of twenty-one inches capable of supporting eight images at a time to print approximately 250 sheets of media per minute. The image receiving member 12 can be made of aluminum having a thickness of approximately three quarters of an inch. The transfix roller 19 can be formed of cylindrical steel material covered with a first layer of 80 durometer urethane which is covered by a 90 durometer urethane.

Referring now to FIG. 1, the image receiving member 12 is shown to include a surface 102 of the image receiving member 14, which is depicted as a rotating drum in the figure. The image receiving member 14 rotates in the direction 16 about an axis 104. The axis 104 defines a longitudinal axis which is disposed substantially perpendicular to a process direction 106 along which a plurality of the individual cut sheets of recording media 49 are transported. The perpendicular direction to the process direction is also known as the cross-process direction. The transfix roller 19, subtending the surface 102 of the drum 12, defines the nip 18 between the surface 102 and the surface of the transfix roller 19 which rotates in the direction 17. A plurality of printheads (not shown) deposits one or more ink images 110 on the surface 102. As one of the sheets 49 enters the nip 18, the ink image 110 is transferred to the media sheet 49. A sheet stripper 112 engages a leading edge 114 of the sheet 49 to remove the sheet 49 from the surface 102 of the drum 12.

The transfix roller 19 rotates about a longitudinal axis 116 in the direction 17 to define the nip 18. The longitudinal axis 116 in not disposed substantially parallel to the cross-process direction, but is offset from the cross-process direction to define a nip. Since the longitudinal axis 116 is skewed with respect to the cross-process direction, the nip is also skewed. As can be seen in FIG. 1, a portion of a surface 118 can be seen illustrating the misalignment of the axis 116 of the transfix roller 19 with the axis 104 of the drum 12.

In one embodiment providing high speed printing, where up to 250 pages per minute are printed during a single pass, the drum 12 can rotate to provide a speed of the surface 102 of approximately forty two inches per second. While the printing process includes the previously described processes of applying a silicon oil, depositing ink on the oil, and transfixing the image, the transfix roller 19 in this embodiment remains engaged with the surface 102 during the entire imaging process. Consequently, the nip 18 remains in place throughout consecutive complete revolutions of the drum 12.

A leading edge 120 of the sheet 49 engages the nip 18 when entering the nip 18 along the process direction 106. A trailing edge 122 of the sheet 49 disengages from the nip 18 when exiting the nip 18 after printing. The nip 18 is also provided at a plurality of interpanel zones 124 located between the trailing edges 122 and the leading edges 120 of sheets 49 since the transfix roller 12 is not removed from the imaging drum 12 during transfixing of consecutive sheets 49. Consequently, during rotation of the drum 12, the transfix roller 19 contacts the interpanel zones 124 as the interpanel zones rotate past the transfix roller 19. The insertion of the sheets 49 into the nip 18 are timed appropriately such that the ink forming an image 110 does not contact the surface 118 of the transfix roller 19.

To constantly engage the transfix roller 19 with the imaging drum 12 during high speed printing, a relatively high amount of force can be provided at the nip to transfix the image at the drum 12 to the sheet 49. In one embodiment, the force applied to the transfix roller 19 is approximately between 3600 and 4200 pounds. Since the transfix roller 19 does not leave the drum 12 during high speed printing, a climb torque disturbance is produced when the leading edge 120 enters the nip 18 due to a height difference between the surface of the drum and the exposed surface of the sheet due to the thickness of the sheet of recording media 49. A fall torque disturbance can also occur when the trailing edge 122 of the sheet of recording media 49 exits the nip 18. The climb torque disturbance or fall torque disturbance can occur while ink is being deposited on the surface 102 of the imaging drum 12 and can disrupt the placement of ink at an intended location on the surface of the drum 12. Torque disturbances can be both acoustic disturbances as well as physical disturbances. If the torque disturbance causes the drum to change velocity by approximately greater than five (5) %, then an image artifact or an error in the image, resulting from the change in velocity can be generated in the image during both the leading edge (climb torque) and trailing edge (fall torque) of the paper.

By skewing the transfix roller 19 with respect to the imaging drum 12, the amount of torque disturbance appearing at the leading and trailing edge can be reduced. In addition, a "thumping" sound, also known as an "acoustic thump", that occurs when the sheet of recording media 49 enters or leaves the nip can also be reduced, thereby reducing the amount of noise produced by a printer during a printing operation. Since a corner of the paper enters the nip initially, the transfix roller can "climb" up the corner of the sheet rather than climbing up the entire width of the sheet at the same time, which would otherwise present an abrupt edge along the length of the transfix roller. In high speed printers, noise reduction is desirable. By reducing or eliminating the acoustic thump, noise reduction can be significant, due to the printing of a large number of sheets of media per minute. Skewing the transfix roller 19 can also improve the uniformity of the nip 18 while reducing the transfix load required when compared to a parallel alignment of the axis 116 of the transfix roller 19 to the axis 104 of the imaging drum 12.

Skewing the transfix roller 19 with respect to the imaging drum 12 can also increase the paper velocity at the leading edges of the sheets due to the angle of the transfix roller 19 with the imaging drum 12. This alignment can reduce the tendency of the sheets to wrinkle. Paper capture time and distance are also improved. The time to walk up or off of the lead edge of the paper varies between 0.008 and 0.012 sec which is dependent on the thickness of the media. The skewed transfix roller can lengthen the capture time by a few milliseconds.

Figure 2:
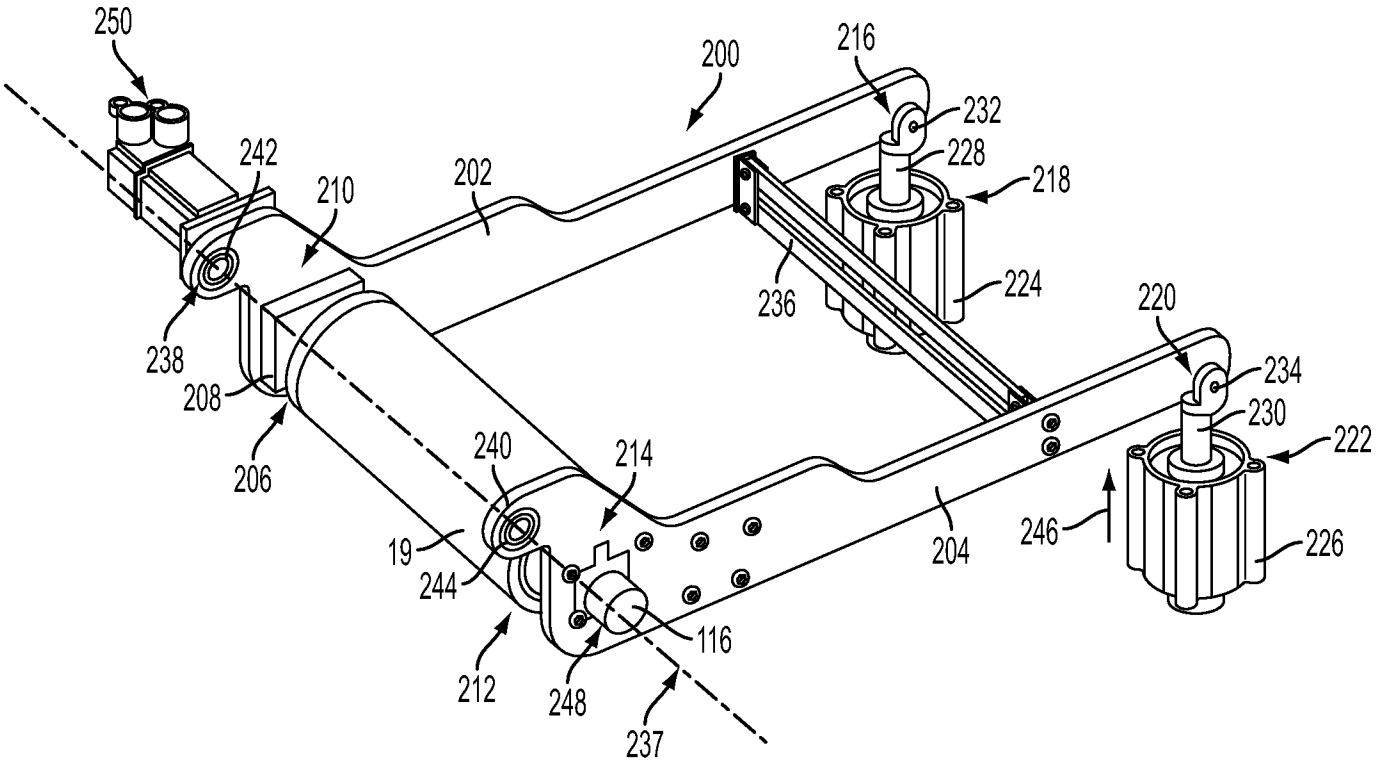
FIG. 2 is perspective view of a load mechanism configured to support and to apply a load to engage a transfix roller to an image receiving member.

As further illustrated in FIG. 2, the transfix roller 19 engages the imaging drum 12 (not shown) from beneath the imaging drum 12 with an applied force provided by a load mechanism 200. The load mechanism 200 includes a first arm 202 and a second arm 204 each of which support the transfix roller 19 for rotation about the axis 116. The transfix roller 19 includes a first end 206 supported by a first bearing block 208 operatively connected to an end 210 of the first arm 202. The transfix roller 19 also includes a second end 212 supported by a second bearing block 209 (see FIGS. 3 and 4) at an end 214 of the second arm 204. An end 216 of first arm 202 is operatively connected to an actuator 218 and an end 220 is operatively connected to an actuator 222. Each of the actuators 218 and 222 include respectively a housing 224 and 226 and a rod 228 and 230. The rods 228 and 230 are rotatably operatively connected to the ends 216 and 220 at pivots 232 and 234 respectively. A support arm 236 connects the first arm 202 to the second arm 204 to provide a stable support structure. The actuators can include a variety of actuators including cam and cam followers, linear actuators and pneumatic cylinders.

To provide a constant force to the image drum 12, the roller 19 is moved into engagement with the imaging drum 12 through movement of the ends 216 and 220 by actuators 218 and 222 about an axis 237. To provide rotation about the axis 237, the end 210 of first arm 202 and the end 214 of second arm 204 include respectively extending portions 238 and 240. Each of the extending portions 238 and 240 include apertures 242 and 244 respectively supporting bearings through which a shaft (not shown) is supported along the axis 237. The shaft and the actuators 218 and 222 are fixedly operatively connected to a frame of the printer such that the shaft and actuators remain stationary with respect to the frame and the imaging drum 12.

To apply a force to the transfix roller 19, each of the actuators 218 and 222 apply an upward force in a direction 246 through actuation of the rods 228 and 230. Upward movement (as illustrated) of the ends 216 and 220 cause the arms to rotate about the axis 237 and move the transfix roller 19 into contact with the imaging drum 12. Other configurations are possible such that the rods 228 and 230 are moved in other directions depending on the arrangement of the transfix roller 19 with respect to the imaging drum 12. The actuators are operatively connected to a controller, such as controller 80, which generates signals to move the actuators 218 and 222 in the designated direction.

In one embodiment, the distance between the axis 237 of the shaft and the axis 116 of the transfix roller 19 is five (5) inches. The distance between the axis 116 and the point of rotation for each arm 202 and 204 about pivots 232 and 234 is 30.4 inches. Consequently, a six to one ratio is developed to provide a mechanical advantage for applying the amount of force necessary to the substantially continuous nip.

The load mechanism 200 can include an encoder 248 operatively connected to the second end 212 of the transfix roller 19 to identify the rotational speed of the transfix roller 19 and consequently the linear speed of a sheet of recording media. A drive motor 250 can be operatively connected to the first end 206 to provide a powered transfix roller 19. In other embodiments, the encoder 248, the motor 250, or both can be eliminated.

Figure 3:
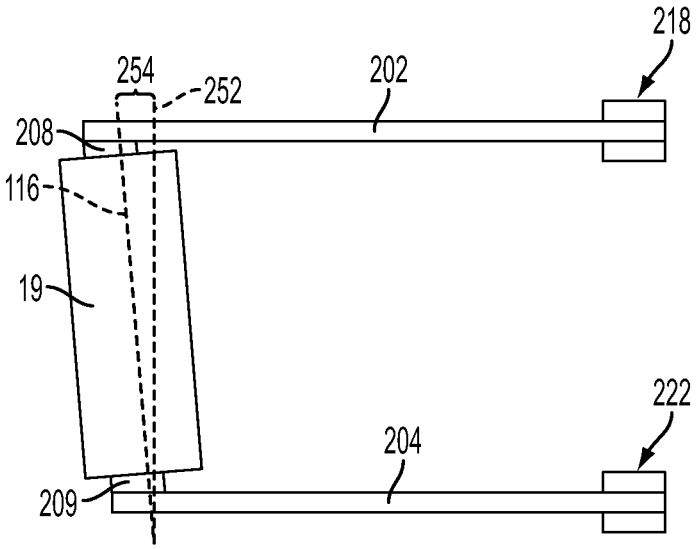
FIG. 3 is a schematic top view of a transfix roller operatively connected to a support to position the transfix roller with respect to an image receiving member.
Figure 4:
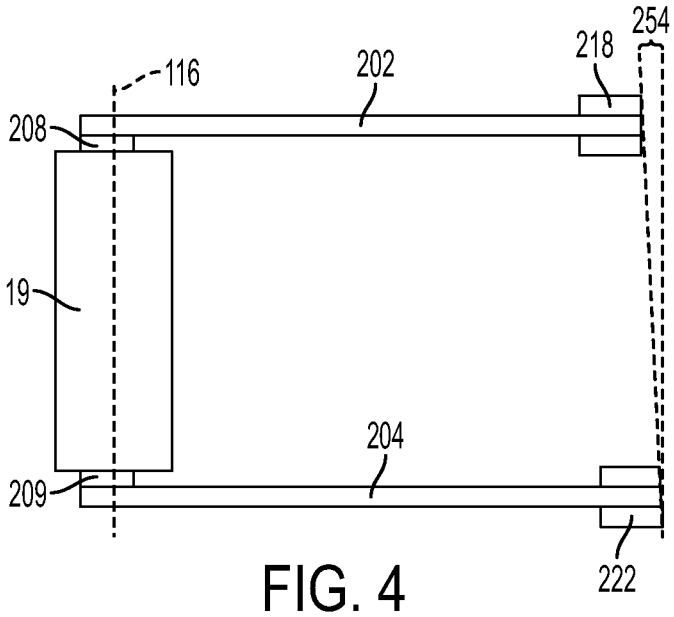
FIG. 4 is a schematic top view of another embodiment of a transfix roller operatively connected to a support to position the transfix roller with respect to an image receiving member.

To provide a skewed transfix roller 19, the load mechanism can be configured as illustrated in FIG. 3 and FIG. 4. For instance in FIG. 3, the bearing blocks 208 and 209 can be configured such that the axis of rotation 116 of the roller is offset from a cross-process direction 252. As illustrated, a skew angle 254 is provided by offsetting the axis of rotation 116 at the ends 210 and 214 of the arms 202 and 204. In another embodiment as illustrated in FIG. 4, a skew angle of the roller 19 with the drum 12 is provided by mounting the roller 19 to the arms such that the axis 116 is substantially perpendicular to a linear axis of the arms 202 and 204. One arm 202, however, is shorter than the other arm 204 to provide the skew angle 254. By mounting the load mechanism 200 to the frame of the printer such that the actuators 218 and 222 are substantially aligned along the cross-process direction, the skew angle of the transfix roller 19 is provided at the imaging drum 12. In another embodiment, it is possible to offset the imaging drum 12 with respect to the cross-process direction and to align the axis 116 of the roller 19 with the cross-process direction.

To provide a nip pressure of one thousand (1000) pounds per square inch at the nip 18 for a drum 12 having diameter of approximately 21.75 inches, the load provided by the load mechanism 200 can range from approximately 3600 pounds to 4200 pounds with a skew angle ranging from zero degrees to two degrees. In one embodiment, a skew angle of two degrees requires an applied force of approximately three thousand eight hundred eighty (3880) pounds. Additionally, at the loads required for a one thousand (1000) pound per square inch nip pressure ranging from approximately 3600 to 4200 pounds, the nip width measured at the center of the drum can range from approximately nine (9) to twelve (12) millimeters or more specifically from approximately 9.2 to 11.35 millimeters. With the skew angle ranging from zero to two degrees, the width of the nip varies only a small amount due to the large size of the imaging drum.

As described herein, the skewed transfix nip can reduce the amount of acoustic thump, produce a correctly located and uniform strain energy along the nip, and provide a small amount of differential velocity at the edges of the sheets of the recording media to reduce a tendency of the sheets to wrinkle when entering the nip. In one embodiment where a skew angle of two degrees is provided, contact pressures along the length of the nip indicate a pressure differential which varies only slightly from one end of the roller 19 to the other end of the roller 19. At two degrees, a nip width of approximately 9.0 millimeters is provided. The applied pressure over the length of the nip at two degrees is fairly consistent and varies less over the entire length of the nip than pressures found at the nips of rollers skewed at zero degrees and at three degrees. A nip width at zero degrees measures approximately 9.25 millimeters and a nip width at three degrees measures approximately 11.35 millimeters.

It will be appreciated that several of the above-disclosed and other features, and functions, or alternatives thereof, can be desirably combined into many other different systems or applications. For instance, the embodiments described herein can be applied to other types of indirect printers. Various presently unforeseen or unanticipated alternatives, modifications, variations, or improvements therein can subsequently be made by those skilled in the art, which are also intended to be encompassed by the following claims.

What is claimed is:

1. A printer to form ink images on a plurality of sheets of recording media moving in a process direction comprising:

an image receiving member defining a first longitudinal axis substantially aligned in a cross-process direction and being configured to receive the ink images; and a transfix roller disposed adjacently to the image receiving member and defining a second longitudinal axis skewed with respect to the first longitudinal axis to define a nip, the transfix roller configured to engage the image receiving member continuously as the image receiving member receives ink images and as a trailing edge of a first sheet of the plurality of sheets of recording media receiving the ink images exits the nip and a leading edge of a second sheet of the plurality of sheets of recording media receiving the ink images enters the nip to enable torque disturbance of the image receiving member and displacement of ink images on the image receiving member to be attenuated.

2. The printer of claim 1, the image receiving member further comprising:

a rotating drum configured to rotate at a predetermined velocity about the first longitudinal axis, the rotating drum including a surface defining a surface area sufficient to support a plurality of the ink images concurrently.

3. The printer of claim 2 wherein the surface area of the image receiving member is large enough to support at least two ink images.

4. The printer of claim 3 wherein an angle of the skew between the transfix roller and the image receiving member reduces a torque disturbance resulting from the transfix roller engaging the leading edge of the second sheet.

5. The printer of claim 4 wherein an angle of the skew between the transfix roller and the image receiving member attenuates torque disturbances that cause the drum to change velocity by approximately five percent or greater than five percent.

6. The printer of claim 5 wherein the angle of skew between the transfix roller and the image receiving member is approximately one to two degrees.

7. The printer of claim 6 wherein the angle of skew between the transfix roller and the image receiving member is approximately two degrees.

8. The printer of claim 7 wherein the image receiving member and the transfix roller are configured to define a nip that is approximately between nine and twelve millimeters in width.

9. The printer of claim 5 further comprising a load mechanism operatively connected to the transfix roller, the load mechanism configured to apply a force to the transfix roller to develop an applied force at the nip of at least one thousand pounds per square inch nip pressure.

10. The printer of claim 9 wherein the load mechanism is configured to supply the force of between three thousand and five thousand pounds.

11. The printer of claim 10 further comprising a motor operatively connected to the rotating drum and configured to move the surface of the drum between forty and forty two inches per second.

12. The printer of claim 11 wherein the rotating drum images approximately two hundred fifty sheets of recording media per minute.

13. The printer of claim 9 wherein the load mechanism is configured to move the transfix roller into and out of engagement with the rotating drum.

14. The printer of claim 3 wherein an angle of the skew between the transfix roller and the image receiving member reduces a torque disturbance resulting from the transfix roller disengaging from the trailing edge of the first sheet.

15. A method of offset printing an image on a plurality of cut sheets of recording media moving along a process direction in an inkjet printer having a transfix roller disposed adjacently to an image receiving member comprising:

engaging the transfix roller with the image receiving member to form a nip with the image receiving member, the transfix roller being skewed with respect to a cross-process direction that is perpendicular to the process direction;

forming a first image on the image receiving member;

forming a space on the image receiving member after forming the first image;

forming a second image on the image receiving member after forming the space; and maintaining engagement of the transfix roller with the image receiving member during forming the first image, forming the space, forming the second image, and as a trailing edge of a first sheet of the plurality of sheets of recording media receiving the images exits the nip and a leading edge of a second sheet of the plurality of sheets of recording media receiving the images enters the nip to enable torque disturbance of the image receiving member and displacement of ink images on the image receiving member to be attenuated.

16. The method of claim 15, the engaging of the transfix roller with the image receiving member further comprises:

engaging the transfix roller with the image receiving member to form an angle offset from approximately one to two degrees with respect to the cross-process direction.

17. The method of claim 16, the engaging of the transfix roller with the image receiving member further comprises:

forming the angle offset from approximately two degrees with respect to the cross-process direction.

18. The method of claim 15, the engaging of the transfix roller with the image receiving member further comprises:

forming the nip between the transfix roller and the image receiving member with a width of approximately between nine and twelve millimeters.

19. The method of claim 15, the engaging of the transfix roller with the image receiving member further comprises:

engaging the transfix roller with the image receiving member with an applied force of approximately three thousand six hundred to four thousand two hundred pounds.

20. The method of claim 15, wherein the engaging of the transfix roller with the image receiving member further comprises:

engaging the transfix roller with the image receiving member to develop an applied force at the nip of approximately one thousand pounds per square inch pressure.

* * * * *